US005144371A

United States Patent [19]

Hays

[11] Patent Number: 5,144,371

[45] Date of Patent: Sep. 1, 1992

[54] DUAL AC/DUAL FREQUENCY SCAVENGELESS DEVELOPMENT

[75] Inventor: Dan A. Hays, Fairport, N.Y.

[73] Assignee: Xerox Corporation, Stamford, Conn.

[21] Appl. No.: 739,359

[22] Filed: Aug. 2, 1991

[51] Int. Cl.[5] ..... G03G 15/08

[52] U.S. Cl. ..... 355/249; 355/261; 355/328

[58] Field of Search ..... 355/247, 249, 245, 326, 355/328, 261, 265, 259; 118/654, 647, 653

[56] References Cited

U.S. PATENT DOCUMENTS

| | | | |
|---|---|---|---|
| 3,457,900 | 7/1969 | Drexler | 118/637 |
| 3,900,001 | 8/1975 | Fraser et al. | 118/637 |
| 4,078,929 | 3/1978 | Sundlach | 96/1.2 |
| 4,308,821 | 1/1982 | Matsumoto et al. | 118/645 |
| 4,478,505 | 10/1984 | Tashiro | 355/245 |
| 4,486,089 | 12/1984 | Itaga et al. | 355/251 |
| 4,568,955 | 2/1986 | Hasoga et al. | 346/153.1 |
| 4,656,427 | 4/1987 | Dauphinee | 324/444 |
| 4,810,604 | 3/1989 | Schmidlia | 430/42 |
| 4,833,504 | 5/1989 | Parker et al. | 355/326 |
| 4,868,600 | 9/1989 | Hays et al. | 355/259 |
| 4,876,573 | 10/1989 | Kamimura | 355/247 X |
| 4,990,958 | 2/1991 | Brewington et al. | 355/245 |
| 4,998,139 | 3/1991 | May et al. | 355/328 X |
| 5,010,367 | 4/1991 | Hays | 355/247 |
| 5,021,838 | 6/1991 | Parker et al. | 355/328 |
| 5,032,872 | 7/1991 | Folkins et al. | 355/259 |
| 5,034,775 | 7/1991 | Folkins | 355/259 |

FOREIGN PATENT DOCUMENTS 6270881 9/1986 Japan .

*Primary Examiner*—A. T. Grimley
*Assistant Examiner*—Sandra L. Brase

[57] ABSTRACT

A scavengeless/non-interactive development system for use in highlight color imaging. The use of dual frequencies for the AC voltages applied between the wires and donor and donor and image receiver of a scavengeless development system allows for greater gap latitude without degradation of line development. Dual frequency refers to the application of an AC voltage at one frequency to the wire electrodes and the simultaneous application of a different frequency AC to the donor structure for insuring proper positioning of the toner cloud relative to the imaging surface.

A relatively low frequency, for example, 2 to 5 kHz AC is applied betweeen the donor and the imaging surface. By applying a relatively low frequency AC to the donor roll, the development gap (or electrode wire to image surface) latitude is enhanced thereby allowing larger gaps to accommodate manufacturing and machine setup tolerances, such as donor roll runout. Application of a high frequency AC, for example, 5 to 15 kHz, between the electrodes and toned donor roll to generate a toner cloud substantially improves the uniformity of development by minimizing wire vibration.

24 Claims, 4 Drawing Sheets

DUAL AC/DUAL FREQUENCY SCAVENGELESS DEVELOPMENT

BACKGROUND OF THE INVENTION

This invention relates generally to the rendering of latent electrostatic images visible using multiple colors of dry toner or developer and more particularly to a non-interactive development system.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 volts) and is referred to as $V_{white}$ or $V_w$.

The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto, et al, an electrophotographic development method and apparatus using two magnetic brushes for developing two-color images which allegedly do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. Developer material is applied to a developer receiving surface in conformity with an electrostatic charge pattern wherein the developer is transported from the developer supply to a development zone while maintained in a magnetic brush configuration and thereafter, transported through the development zone magnetically unconstrained but in contact with the developer receiving surface.

As disclosed in U.S. Pat. No. 4,486,089 granted on Dec. 4, 1984 to Itaya, et al magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted on May 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus, the '604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means to a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an AC power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an A.C. and a DC source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush. The brush is spaced from the image bearing member and an AC field is formed across the space to effect toner transfer to the image and non-image areas and to effect a back transfer of excessive toner.

Japanese publication 62-70881 discloses a toner separating means using a plurality of electrically biased grid wires disposed intermediate a magnet brush developer roll and an imaging surface. The two-component developer is triboelectrified and magnetic carrier is removed from the outer periphery of a sleeve by the action of the north and south poles of the magnetic poles of the magnetic brush.

U.S. Pat. No. 4,868,600 granted to Hays et al on Sept. 19, 1989 and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. Patent application Ser. No. 424,482 filed on Oct. 20, 1989 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

Some highlight and process color electronic printing concepts are based on multiple xerographic development of an electrostatic latent image on either a photoreceptor or electroreceptor. These printing system concepts can be enabled by development system designs that do not scavenge/interact with a previously toned image or cause cross contamination of the development systems. Since the present commercial two component development systems such as magnetic brush development and single component systems such as jumping interact with the image bearing member, there is a need to identify scavengeless or non-interactive development systems. Recent developments which address this need include powder cloud development systems based on AC fringe electric field toner detachment from a toned donor roll. The AC fringe electric field is provided by self-spaced AC based electrode structures such as wires positioned within the development nip. This configuration is incorporated in a single component development system ('600 patent mentioned above) and a scavengeless hybrid system, described in U.S. Pat. No. 5,032,872 granted to Folkins et al on Jul. 16, 1991, in which the toned donor is supplied by two component magnetic brush development. As described in the '872 patent, scavengeless hybrid development uses a two-component magnetic brush development system to load one or more donor rolls with toner.

U.S. Pat. No. 5,010,367 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image. In this device the frequencies of the AC voltages applied between the donor and image receiver and between the wires and the donor roll are in the order of 4 to 10 kHz. While a range of frequencies is specified in the '367 patent the two voltages referred to are applied at the same frequency as evidenced by the fact that the donor and wire voltages are specified as being either in-phase or out-of-phase. If the two frequencies were not the same, when out-of-phase voltages are used then the two voltages would at some point in time be in phase. Likewise, if when in-phase voltages were used, the frequencies were not the same then at some point in time the two voltages would be out-of-phase. In other words, if the two voltages of the '367 patent were different, the phase relationship of the two voltages could not be maintained over time.

In the '367 patent, the donor to imaging surface gap was specified as being 318 μm or approximately 250 μm between the electrode wires and the imaging surface when the toner particle and electrode wire size are taken into account. As will be appreciated, 250 μm is a relatively small gap which presents problems in manufacturing and setup of such a developer system. It is desirable to be able to space the wire electrodes a greater distance than 250 μm from the imaging surface in order to accommodate present manufacturing and machine setup tolerances.

With an increase of the gap between the wires and the image receiver it would be necessary to apply an AC voltage at a relatively low frequency between the donor and image receiver to insure proper toner cloud spacing relative to the image receiver. If the teaching of the '367 patent were followed in this situation a correspondingly low frequency AC voltage would be applied between the wires and donor. However, it has been found that a relatively high frequency AC must be applied between the wires and the donor in order to avoid non-uniform development accompanying excessive wire vibration.

As will be appreciated, it would be desirable to position the wires of the device disclosed in the '367 patent at a greater distance from their associated imaging surface without degradation of image quality.

BRIEF SUMMARY OF THE INVENTION

In accordance with the present invention, the use of dual frequencies for the AC voltages applied to the wires and donor of a scavengeless development system allows for greater gap latitude without degradation of the quality of line development. Dual frequency refers to the application of an AC voltage at one frequency to the wire electrodes for minimizing wire vibration and the simultaneous application of a different frequency AC to the donor structure for insuring proper positioning of the toner cloud relative to the imaging surface.

A relatively low frequency, for example, 2 to 5 kHz, AC is applied between the donor and the imaging surface. By applying a relatively low frequency AC to the donor roll, the development gap or electrode wire to image surface spacing latitude is enhanced thereby allowing larger gaps to accommodate manufacturing and machine setup tolerances, such as donor roll runout. Application of a high frequency AC, for example, 5 to 15 kHz, between the electrodes and toned donor to generate a toner cloud substantially improves the uniformity of development by minimizing wire vibration.

DETAILED DESCRIPTION OF THE PREFERRED EMBODIMENT OF THE INVENTION

Figure 1A:
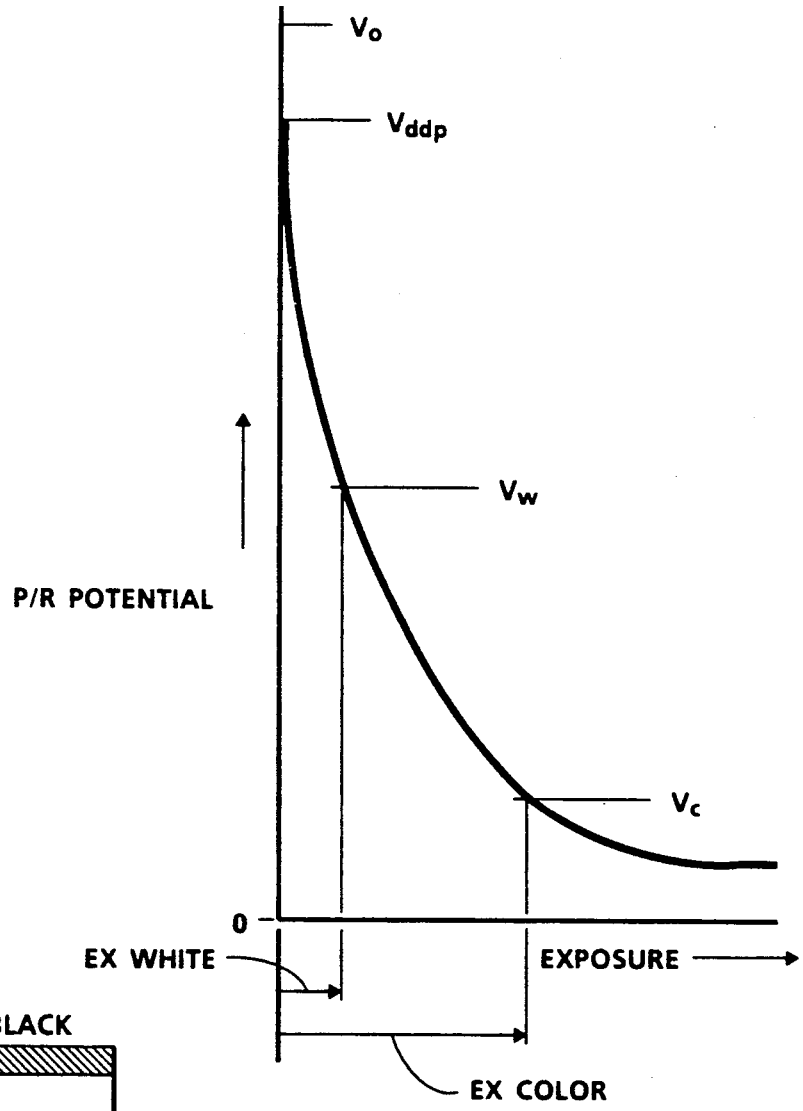
FIG. 1*a* is a plot of photoreceptor potential versus exposure illustrating a tri-level electrostatic latent image.
Figure 1B:
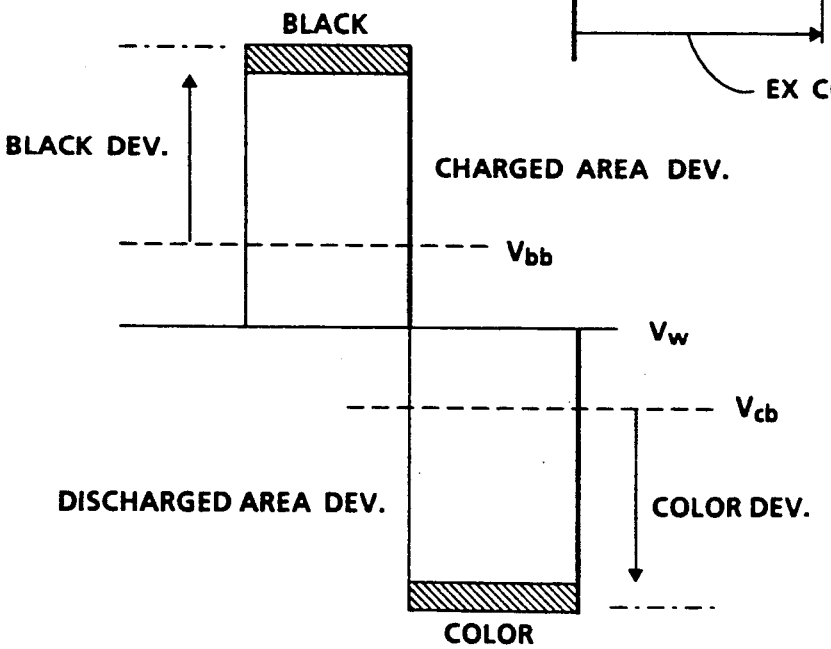
FIG. 1*b* is a plot of photoreceptor potential illustrating single-pass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_O$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
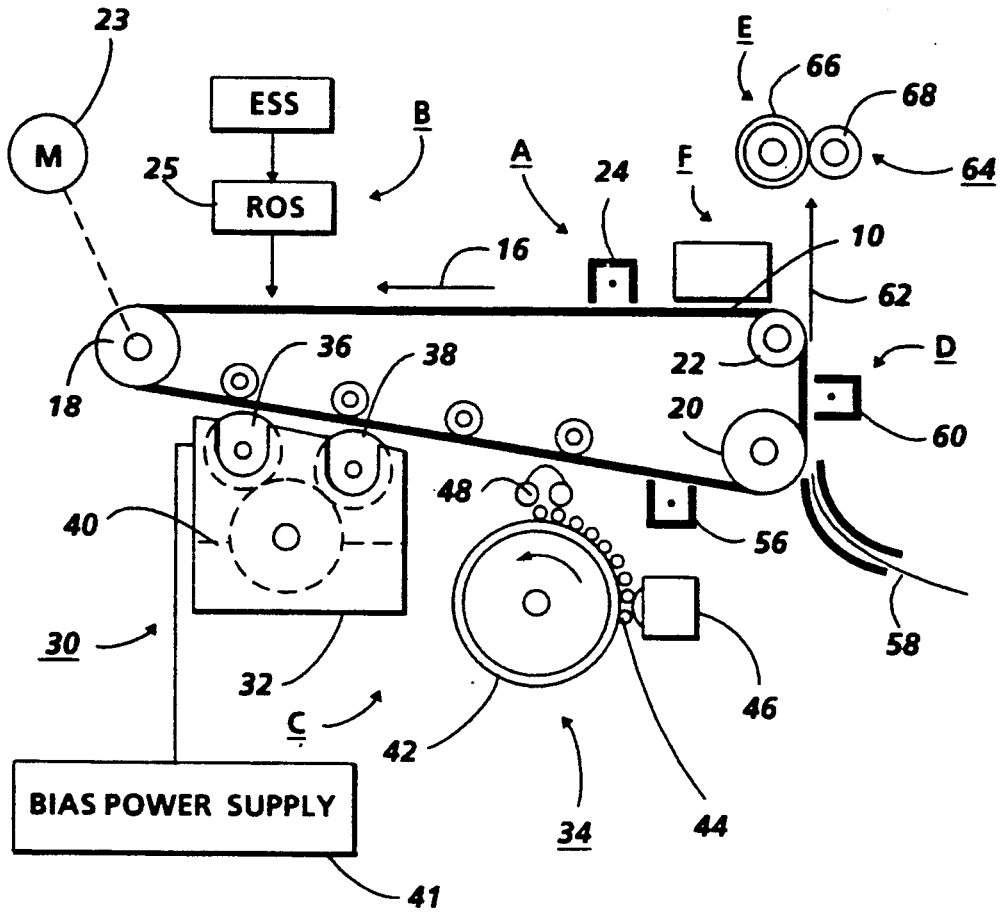
FIG. 2 is a schematic illustration of a printing apparatus incorporating the inventive features of the invention.

As shown in FIG. 2, a highlight color printing machine in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. See FIG. 1*a*. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 37 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. DuPont De Nemours) or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 4,868,600 granted to Hays et al on Sep. 19, 1989.

Figure 3:
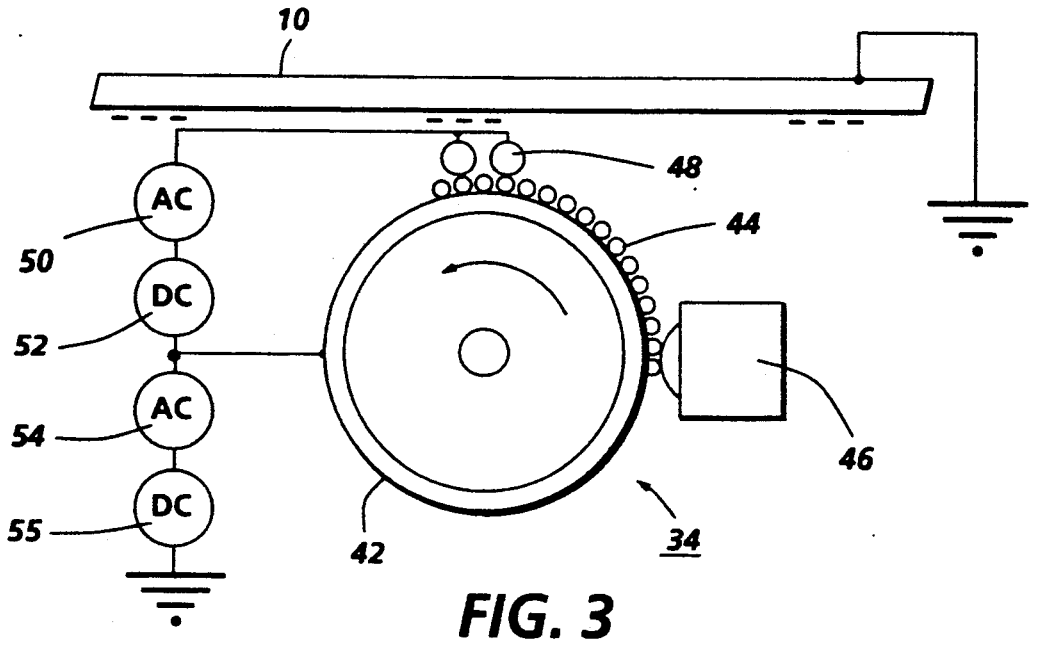
FIG. 3 is a fragmentary schematic view of a development structure according to the invention.

As illustrated in FIG. 3, an alternating electrical bias is applied to the electrode structure 48 via an AC voltage source depicted by reference character 50. The applied AC establishes an alternating electrostatic field between the wires and the donor structure which is effective in detaching toner from the surface of the donor structure and forming a toner cloud intermediate the donor structure 42 and the charge retentive surface. Once formed, the toner cloud's proximity to the image receiving surface is controlled by the application of an AC/DC bias voltage applied between the donor roll/wire electrode assembly and ground via AC source AC depicted by reference character 54 and DC source 55.

In the device disclosed in '367 patent, the magnitude of the AC voltage is relatively low and is in the order of 200 to 300 volts peak at a frequency of about 4 kHz up to 10 kHz. A DC bias supply 52 applies approximately 0 to 50 volts on the wires 48 relative to the donor structure 42. At a spacing of approximately 25 μm between the electrode and donor structures an applied voltage of 200 to 300 volts produces a relatively large electrostatic field without risk of air breakdown. The use of a dielectric coating on either of the structures helps to prevent shorting of the applied AC voltage. The field strength produced is on the order of 8 to 16 volts/$\mu$m.

When an AC voltage of approximately 270 volts is applied to the wires of the '367 device as noted above, an AC bias at a frequency of 4 to 10 kHz is applied via the source 54. Simultaneously, a DC bias of approximately −600 volts is applied via the source 55 for establishing a development field between the donor and the image receiver such that charged area development (CAD) is effected.

In the '367 patent, the donor to imaging surface gap was specified as being 318 $\mu$m or approximately 250 $\mu$m between the electrode wires and the imaging surface when the toner particle and electrode wire size are taken into account. As will be appreciated, 250 $\mu$m is a relatively small gap which presents problems in manufacturing and setup of such a developer system. It is desirable to be able to space the wire electrodes a greater distance than 250 ▮m from the imaging surface in order to accommodate present manufacturing and machine setup tolerances.

With an increase of the gap between the wires and the image receiver it would be necessary to apply an AC voltage at a relatively low frequency between the donor and image receiver to insure proper toner cloud spacing relative to the image receiver. If the teaching of the '367 patent were followed in this situation a correspondingly low frequency AC voltage would be applied between the wires and donor. However, it has been found that a relatively high frequency AC must be applied between the wires and the donor in order to avoid non-uniform development accompanying excessive wire vibration.

As will be appreciated, it would be desirable to position the wires of the device disclosed in the '367 patent at a greater distance from their associated imaging surface without degradation of image quality.

While a range of frequencies is specified in the '367 patent the two voltages referred to are applied at the same frequency as evidenced by the fact that the donor and wire voltages are specified as being either in-phase or out-of-phase. If the two frequencies were not the same, when out-of-phase voltages are used then the two voltages would at some point in time be in phase. Likewise, if when in-phase voltages were used, the frequencies were not the same then at some point in time the two voltages would be out-of-phase. In other words, if the two voltages of the '367 patent were different, the phase relationship of the two voltages could not be maintained over time.

In accordance with the present invention, the use of dual frequencies for the AC voltages applied to the wires and donor of a scavengeless development system provides development gap latitude and improves the scavengeless development of lines for different development gaps. The application of a high frequency $AC_{hf}$50, for example, 5 to 15 kHz between the electrodes and toned donor to generate a toner cloud substantially increases development uniformity. A relatively low frequency, for example, 2 to 5 kHz, $AC_{lf}$55 is applied between the donor and the imaging surface.

To test the dual frequency concept, copies were produced by a dual AC frequency scavengeless development system in a breadboard operating at a process speed of 12 cm/s. Discharged area development (DAD) was used with the photoreceptor charged to a $V_{ddp}$ of −450 volts and discharge (background) potential of −100 volts to provide a −350 volts contrast potential. The breadboard was configured similar to the structure depicted in FIG. 3 of the drawings. The donor roll was toned with a single component toner metering/charging process although a two component development system could also be used to load a toner layer on the donor roll. The scavengeless development nip was formed with two 73 $\mu$m tungsten wires in self-spaced contact with a toned donor roll and biased with an AC voltage, $AC_w$, of 300 volts peak at a frequency of 10 kHz. The DC voltage on the wires, $DC_w$, was set at 0 volts.

The development of line images is of particular interest since if the toner cloud formed by the scavengeless nip is not sufficiently close to the image receiver, the developed line widths will be narrowed. Several types of line images were developed, transferred and fused on paper as a function of the amplitude and frequency of the donor AC voltage, $AC_D$, for different development zone wire-to-receiver gaps. The widths of the lines were measured with a Zeiss microdensitometer.

Figure 4:
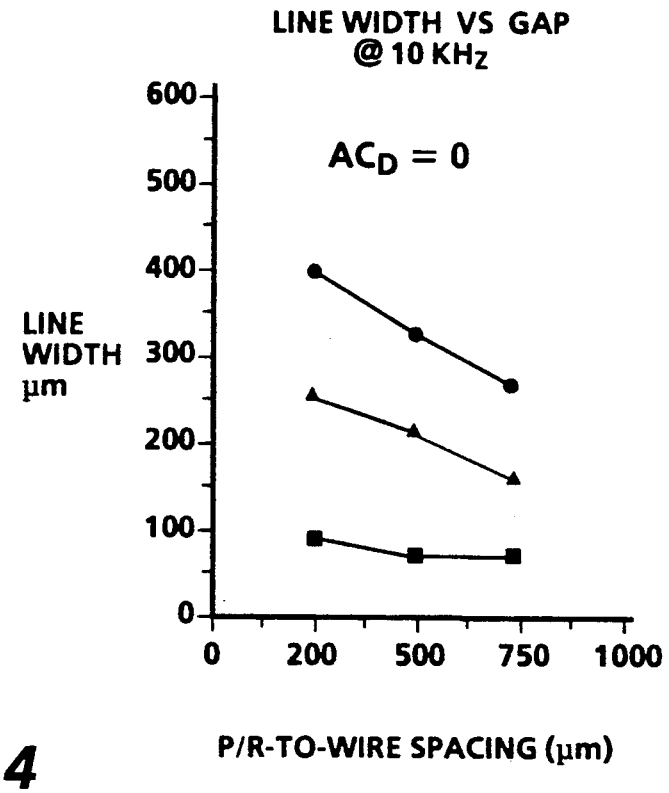
FIG. 4 illustrates that line width development is a function of electrode wire to imaging surface spacing, in that, line width development decreases as the development gap increases.

FIG. 4 shows the line widths of several line types as a function of the gap when $AC_d=0$ and the frequency of the AC applied to the wire electrodes is 10 kHz. The line widths were measured for a donor roll DC bias $V_d$ set at the threshold for background development. The arrows directed towards the ordinate indicate the line width on the input target. The upper set of data represents a wide high density line with an input line width of 473 $\mu$m and peak contrast potential of 334 volts. The middle data set represents a wide low density line with an input line width of 433 $\mu$m and contrast potential of 202 volts. The lower data set corresponds to a narrow high density line with an input width of 114 $\mu$m and peak contrast potential of 226 volts. All of the line widths decrease as the development gap increases. Line narrowing is particularly aggravated for the low input density line (middle data set). To obtain the best line development when AC is only applied to the wire electrodes ($AC_D=0$), the P/R-to-wire spacing must be made as small as possible within the constraints of mechanical tolerances.

Figure 5:
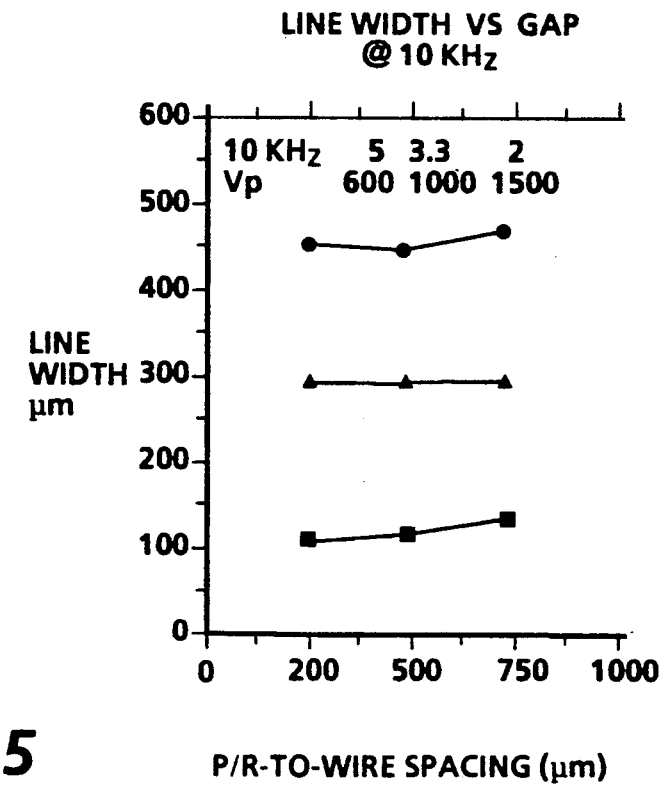
FIG. 5 illustrates the advantage of using dual frequency AC voltages applied to the wire electrodes and the donor.

FIG. 5 graphically illustrates the benefit of using dual AC frequency scavengeless development to increase line widths. For each gap setting, the AC frequency and peak amplitude applied to the donor were optimized to obtain the maximum line width without background development. The particular frequency and amplitude chosen are not unique since one can find other acceptable combinations for each gap setting. The optimized values correspond to larger AC amplitudes of toner particle motion for the wider gaps. It is clear from FIG. 5 that the dual AC dramatically improves the developed line widths.

Since dual frequency AC scavengeless development enables line development for gaps as large as 750 ▮m, it would seen that one would prefer to use larger development gap settings since more uniform solid area development is expected for fixed tolerances in the donor roll runout and spacing. However, when the copies obtained at a process speed of 12 cm/s with gaps between 500 and 1250 ▮m are carefully examined, one observes a copy quality defect in which the edges of solid areas parallel to the process direction are eroded. The effect becomes particularly pronounced for the larger gap settings. For gap settings less than ~500 ▮m, this effect is not noticeable.

Figure 6:
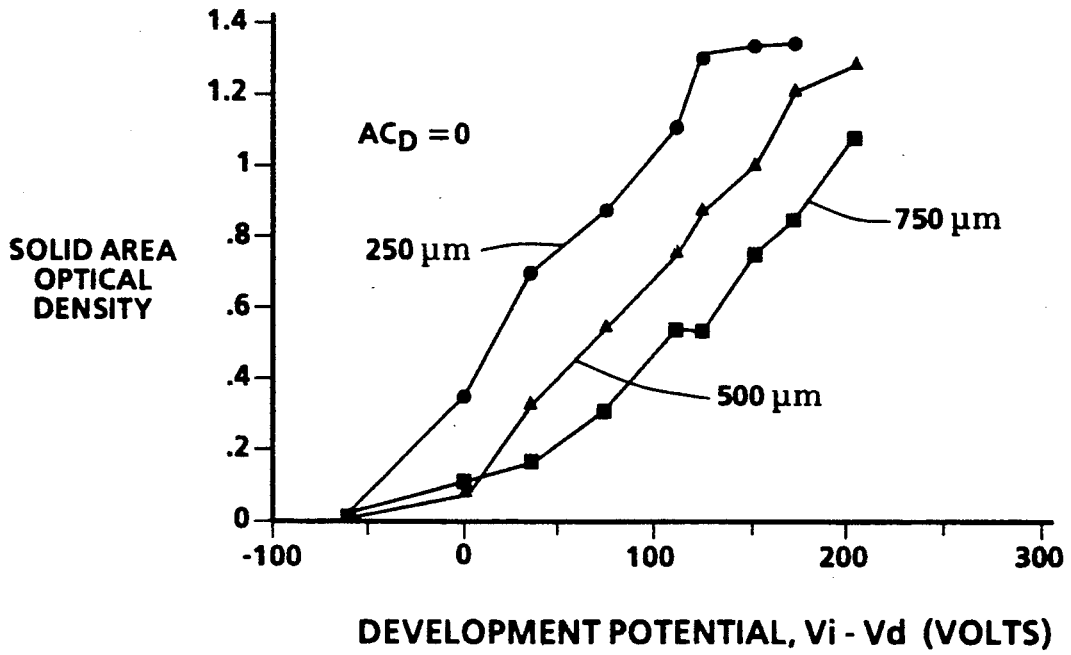
FIG. 6 illustrates a comparison of solid area optical density as a function of development potential for 250, 500 and 750 μm gaps between the imaging surface and wire electrodes when no AC is applied between the donor and the imaging surface
Figure 7:
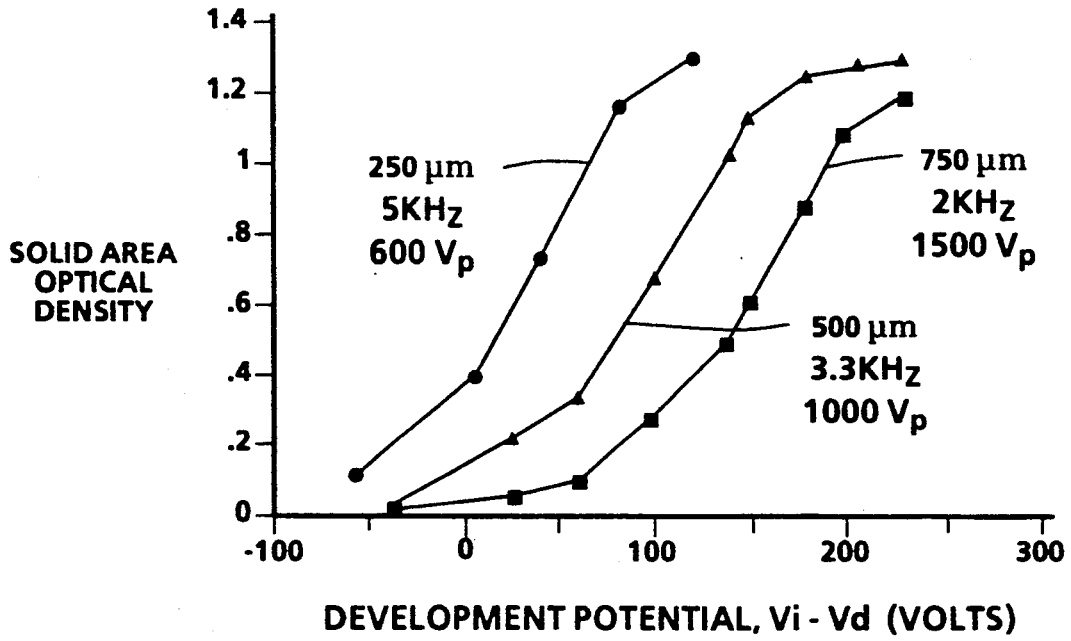
FIG. 7 illustrates a comparison of solid area optical density as a function of development potential for 250, 500 and 750 μm gaps between the imaging surface and wire electrodes when relatively low frequency AC is applied between the donor and the imaging surface

When the gap is increased, the solid area development decreases. For conventional scavengeless development with $AC_D=0$, FIG. 6 shows a comparison of the solid area optical density as a function of the development potential for the 250, 500 and 750 μm gaps. Corresponding data for optimized dual frequency settings is shown in FIG. 7.

For a gap setting of ~500 μm, the decrease in solid area development can be recovered by increasing the photoreceptor charging (contrast potential). The increase in contrast potential should also increase line widths. From FIG. 5, note that the line width of the wide low density line is much less than the width of the wide high density line. It follows that for a process speed of ~12 cm/s, scavengeless development can be obtained for a development gap of 275 to 500 μm provided one uses an optimized dual frequency AC and higher photoreceptor charging to recover any undesired loss in solid area development.

In bringing the toner cloud close to the image receiver with the dual AC, one is apt to encounter conditions in which the development is scavenging. To ascertain the conditions for scavenging, a machine test procedure was devised which involved developing images on the photoreceptor, discharging the photoreceptor with an erase lamp and then redeveloping the images under back bias conditions of 250 volts. For the dual AC conditions of 3.3 kHz and 600 volts peak for a 250 μm gap, scavenging is observed. For those applications where high quality prints are desired with low image noise and no directional effects, this operating set point is acceptable. For those system applications where the scavengeless characteristic is desired, we found that a frequency of 5 kHz at 600 volts peak also provided good fine line development and no image scavenging.

Subsequent to image development a sheet of support material 68 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 70 is provided to condition the toner for effective transfer to a substrate using negative corona discharge.

Transfer station D includes a corona generating device 72 which sprays ions of a suitable polarity onto the backside of sheet 68. This attracts the charged toner powder images from the belt 10 to sheet 68. After transfer, the sheet continues to move, in the direction of arrow 74, onto a conveyor (not shown) which advances the sheet to fusing station E.

Fusing station E includes a fuser assembly, indicated generally by the reference numeral 76, which permanently affixes the transferred powder image to sheet 68. Preferably, fuser assembly 76 comprises a heated fuser roller 78 and a backup roller 80. Sheet 68 passes between fuser roller 78 and backup roller 80 with the toner powder image contacting fuser roller 78. In this manner, the toner powder image is permanently affixed to sheet 68. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

What is claimed is:

1. Apparatus for forming images on an image receiving surface with developer, said apparatus comprising:

a supply of marking particles;

means for transporting marking particles from said supply to an area adjacent said image receiving surface;

means including an AC voltage source operated at a first frequency for forming transported marking particles into a uniform cloud of marking particles;

means including an AC voltage source operated at a second frequency different from said first frequency for controlling the spacing of said marking particle cloud relative to said image receiver without strongly interacting with said image receiving surface;

said means for forming transported marking particles into a cloud comprising a wire electrode structure disposed between said transport and said image receiving surface;

said first frequency being relatively high for minimizing wire electrode vibration and said second frequency being relatively low for enabling a relatively large gap between said image receiving surface and said wire electrode structure; and said first frequency being in the order of 5–15 kHz and said second frequency being in the order of 3–5 kHz.

2. Apparatus according to claim 1 wherein said AC bias voltages have a different magnitude.

3. Apparatus according to claim 2 including means for forming tri-level images on said image receiving surface.

4. Apparatus according to claim 3 including means for forming said tri-level image in a single pass of said image receiving surface past process stations used in forming said images.

5. Apparatus according to claim 4 wherein said supply of marking particles comprises a single component.

6. Apparatus according to claim 5 wherein said marking particles comprise toner.

7. Apparatus according to claim 6 wherein said toner transport comprises a donor roll.

8. Apparatus according to claim 7 including another supply of toner.

9. Apparatus according to claim 8 wherein said tri-level images comprise two image areas and a background area.

10. Apparatus according to claim 9 wherein said toner supply is utilized for developing one of said two images and said another of said toner supplies is utilized for developing the other of said two images.

11. Apparatus for forming images on an image receiving surface with developer, said apparatus comprising:

a supply of marking particles;

means for transporting marking particles from said supply to an area adjacent said image receiving surface;

means including an AC voltage source operated at a first frequency for forming transported marking particles into a uniform cloud of marking particles;

means including an AC voltage source operated at a second frequency different from said first frequency for controlling the spacing of said marking particle cloud relative to said image receiver without strongly interacting with said image receiving surface.

said means for forming transported marking particles into a cloud comprising a wire electrode structure disposed between said transport and said image receiving surface; and said first frequency being relatively high for minimizing wire electrode vibration and said second frequency being relatively low for enabling a relatively large gap between said image receiving surface and said wire electrode structure.

12. Apparatus for forming images on an image receiving surface with developer, said apparatus comprising:

a supply of marking particles;

means for transporting marking particles from said supply to an area adjacent said image receiving surface;

means including an AC voltage source operated at a first frequency for forming transported marking particles into a uniform cloud of marking particles; and means including an AC voltage source operated at a second frequency different from said first frequency for controlling the spacing of said marking particle cloud relative to said image receiver without strongly interacting with said image receiving surface;

said means for forming transported marking particles into a cloud comprising a wire electrode structure;

said means for forming transported marking particles into a cloud being disposed between said transport and said image receiving surface;

said first frequency being relatively high for minimizing wire electrode vibration and said second frequency is relatively low for enabling a relatively large gap between said image receiving surface and said wire electrode structure; and wherein said gap is in the order of 250 to 500 μm.

13. In a method for forming images on an image receiving surface with developer, the steps including:

providing a supply of marking particles;

transporting developer from said supply to an area adjacent said image receiving surface;

using an AC voltage having a first frequency, forming transported developer into a cloud of marking particles; and using an AC voltage having a second frequency different form said first frequency, controlling the spacing of said marking particle cloud relative to said image receiver without touching said image receiving surface, said controlling step being independent of said forming step;

said step of forming transported marking particles into a cloud including using a wire electrode structure;

said step of forming transported marking particles into a cloud including disposing said wire electrode structure between said transport and said image receiving surface and wherein said step of using an AC voltage has a first frequency comprises using a relatively high frequency for minimizing wire electrode vibration and said step of using an AC voltage has a second frequency comprises using a relatively low frequency for enabling a relatively large gap between said image receiving surface and said wire electrode structure.

14. The method according to claim 13 wherein said first frequency is in the order of 5–15 kHz and said second frequency is in the order of 3–5 kHz.

15. The method according to claim 14 wherein said AC bias voltages have a different magnitude.

16. The method according to claim 15 including the step of forming tri-level images on said image receiving surface.

17. The method according to claim 16 wherein said step of forming tri-level images on said image receiving surface comprises forming said tri-level images in a single pass of said image receiving surface past process stations used in forming said images.

18. The method according to claim 17 wherein said supply of marking particles comprises a single component.

19. The method according to claim 18 wherein said marking particles comprise toner.

20. The method according to claim 19 wherein said toner transport comprises a donor roll.

21. The method according to claim 20 including the step of providing another supply of toner.

22. The method according to claim 21 wherein said tri-level images comprise two image areas and a background area.

23. The method according to claim 22 wherein said toner supply is utilized for developing one of said two images and said another of said toner supplies is utilized for developing the other of said two images.

24. The method according to claim 16 wherein said gap is in the order of 250 to 500 μm.

* * * * *